US011724371B2

(12) United States Patent
Murui et al.

(10) Patent No.: US 11,724,371 B2
(45) Date of Patent: Aug. 15, 2023

(54) POWER TOOL AND PROCESSING DEVICE

(71) Applicant: Panasonic Intellectual Property Management Co., Ltd., Osaka (JP)

(72) Inventors: Itaru Murui, Nara (JP); Mitsumasa Mizuno, Osaka (JP); Hiroaki Murakami, Mie (JP); Takashi Kusagawa, Osaka (JP); Masahiro Sato, Nara (JP); Masanori Nakamoto, Mie (JP); Akiko Honda, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/274,066

(22) PCT Filed: Jun. 26, 2019

(86) PCT No.: PCT/JP2019/025442
§ 371 (c)(1),
(2) Date: Mar. 5, 2021

(87) PCT Pub. No.: WO2020/049840
PCT Pub. Date: Mar. 12, 2020

(65) Prior Publication Data

US 2021/0252681 A1 Aug. 19, 2021

(30) Foreign Application Priority Data

Sep. 7, 2018 (JP) ..... 2018-167970

(51) Int. Cl.
*B25B 23/147* (2006.01)
*B25F 5/02* (2006.01)

(52) U.S. Cl.
CPC ..... *B25B 23/147* (2013.01); *B25F 5/021* (2013.01)

(58) Field of Classification Search
CPC ... B25B 23/147; B25B 23/1475; B25F 5/021; B25F 5/00
See application file for complete search history.

(56) References Cited

U.S. PATENT DOCUMENTS 7,760,070 B2 * 7/2010 Ohtaki ..... B60R 25/04 382/104
8,264,374 B2 9/2012 Obatake et al.
(Continued)

FOREIGN PATENT DOCUMENTS

EP 2248632 A1 11/2010
EP 3047943 A2 7/2016
(Continued)

OTHER PUBLICATIONS

International Search Report issued in corresponding International Patent Application No. PCT/JP2019/025442, dated Sep. 10, 2019, with English translation.
(Continued)

*Primary Examiner* — Thomas M Wittenschlaeger
*Assistant Examiner* — Katie L Gerth
(74) *Attorney, Agent, or Firm* — McDermott Will & Emery LLP

(57) ABSTRACT

An electric power tool includes: an output shaft on which a front-end tool is adapted to be mounted; and a power transmission mechanism that transmits a rotational output of a motor to the output shaft. A posture information acquisition unit acquires posture information for identifying a posture of the electric power tool. A torque information acquisition unit acquires torque information indicating a measured value of tightening torque produced by the front-end tool. A transmission unit transmits the posture informa-
(Continued)

tion, the torque information, and time information related to a time when respective information is acquired to an external apparatus.

7 Claims, 5 Drawing Sheets

(56) References Cited

U.S. PATENT DOCUMENTS

| | | | | |
|---|---|---|---|---|
| 9,537,335 | B2 | 1/2017 | Furui et al. | |
| 9,595,839 | B2 | 3/2017 | Furui et al. | |
| 9,780,583 | B2 | 10/2017 | Furui et al. | |
| 10,396,573 | B2 | 8/2019 | Furui et al. | |
| 10,749,360 | B2 | 8/2020 | Furui et al. | |
| 11,014,222 | B2 | 5/2021 | Hohmann et al. | |
| 11,114,870 | B2 | 9/2021 | Furui et al. | |
| 2010/0265097 | A1 | 10/2010 | Obatake et al. | |
| 2014/0151079 | A1 | 6/2014 | Furui et al. | |
| 2014/0159662 | A1 | 6/2014 | Furui et al. | |
| 2014/0159919 | A1 | 6/2014 | Furui et al. | |
| 2014/0159920 | A1 | 6/2014 | Furui et al. | |
| 2015/0041164 | A1* | 2/2015 | Sergyeyenko | B25B 21/008 173/176 |
| 2015/0272574 | A1* | 10/2015 | Leimbach | G05F 1/563 713/323 |
| 2016/0184952 | A1* | 6/2016 | Kabza | B23Q 11/14 173/2 |
| 2016/0207180 | A1 | 7/2016 | Hohmann et al. | |
| 2017/0129090 | A1 | 5/2017 | Yamamoto | |
| 2017/0173749 | A1* | 6/2017 | Stock | G08B 21/02 |
| 2017/0193761 | A1* | 7/2017 | Suzuki | H04B 1/03 |
| 2018/0013360 | A1* | 1/2018 | Eshleman | B25F 5/00 |
| 2018/0076639 | A1 | 3/2018 | Furui et al. | |
| 2018/0107191 | A1* | 4/2018 | Kubat | G05B 19/41815 |
| 2019/0083821 | A1 | 3/2019 | Sauerbier et al. | |
| 2019/0126456 | A1* | 5/2019 | Abbott | H02K 11/21 |
| 2019/0334357 | A1 | 10/2019 | Furui et al. | |
| 2020/0343744 | A1 | 10/2020 | Furui et al. | |

FOREIGN PATENT DOCUMENTS

| | | | |
|---|---|---|---|
| JP | S56-069087 | A | 6/1981 |
| JP | 2005-177919 | A | 7/2005 |
| JP | 2006-95626 | A | 4/2006 |
| JP | 2011-031340 | A | 2/2011 |
| JP | 2014-525840 | A | 10/2014 |
| JP | 2016-091316 | A | 5/2016 |
| JP | 2017-87359 | A | 5/2017 |
| WO | 2013/014914 | A2 | 1/2013 |
| WO | 2017190799 | A1 | 11/2017 |

OTHER PUBLICATIONS

Extended European Search Report issued in corresponding European Patent Application No. 19858618.2, dated Oct. 11, 2021.

* cited by examiner

FIG. 4

| ELECTRIC POWER TOOL | WORK HOUR (h) | TOOL POSTURE | | | BOLT TYPE | | | | |
|---|---|---|---|---|---|---|---|---|---|
| | | | | | BOLT DIAMETER | | | BOLT LENGTH | |
| | | ORIENTED DOWNWARD | ORIENTED SIDEWAYS | ORIENTED UPWARD | SMALL | MEDIUM | LARGE | SHORT | LONG |
| ELECTRIC POWER TOOL A | Ta | 10% | 10% | 80% | 80% | 10% | 10% | 80% | 20% |
| ELECTRIC POWER TOOL B | Tb | 30% | 60% | 10% | 50% | 30% | 20% | 70% | 30% |
| ELECTRIC POWER TOOL C | Tc | 50% | 30% | 20% | 10% | 10% | 80% | 20% | 80% |

POWER TOOL AND PROCESSING DEVICE

CROSS-REFERENCE OF RELATED APPLICATIONS

This application is the U.S. National Phase under 35 U.S.C. § 371 of International Patent Application No. PCT/JP2019/025442, filed on Jun. 26, 2019, which in turn claims the benefit of Japanese Patent Application No. 2018-167970, filed on Sep. 7, 2018, the entire disclosures of which Applications are incorporated by reference herein.

TECHNICAL FIELD

The present disclosure relates to an electric power tool and a processing apparatus.

BACKGROUND ART

Patent literature 1 discloses a work management apparatus including a work information acquisition unit that acquires work information related to the content of work, a positional information acquisition unit that acquires positional information on a place of work, a workpiece information acquisition unit that acquires workpiece information, and an information management unit that stores the work information, the positional information, and the workpiece information in a storage unit, mapping the information to each other. The work management apparatus further includes a determination unit that determines the properness of a work by referring to data for a design drawing. The result of determining the properness of a work is displayed on a display unit.

[Patent Literature 1] JP2016-91316

SUMMARY OF INVENTION

Technical Problem

There are various types of electric power tools having different mechanisms. A drill driver is a widely-used tool and is used to tighten a screw or bore a hole. An impact driver has an impact mechanism for generating a tightening torque by applying a striking impact in a rotational direction. A multi-impact driver has the functions of both a drill driver and an impact driver. An impact wrench generates a tightening torque greater than that of an impact driver. These electric power tools have different structures, but all of them can be used to tighten a wood screw. It is also common in the case of other types of work that a plurality of types of electric power tools can be used. Therefore, a user may not be able to make up his or her mind which type of tool should be chosen for purchase.

Further, electric power tools of the same type are available in various product specifications such as the battery back mounted, charging time, maximum tightening torque, availability of manual tightening capability, dimension of the main unit, mass of the main unit, etc. Since there are numerous options for choosing a tool, it is not easy for a user to choose a tool suited to the content of his or her work.

The disclosure addresses the above-described issue, and a general purpose thereof is to provide a technology necessary to present recommendation information related to the electric power tool to a user.

Solution to Problem

An electric power tool according to an embodiment of the present disclosure includes: an output shaft on which a front-end tool is adapted to be mounted; a power transmission mechanism that transmits a rotational output of a driving source to the output shaft; a posture information acquisition unit that acquires posture information for identifying a posture of the electric power tool; a torque information acquisition unit that acquires torque information indicating a measured value of tightening torque produced by the front-end tool; and a transmission unit that transmits the posture information, the torque information, and time information related to a time when respective information is acquired to an external apparatus.

A processing apparatus according to another embodiment of the present disclosure includes: an information acquisition unit that acquires posture information for identifying a posture of an electric power tool, torque information indicating a measured value of tightening torque, and time information related to a time when the torque information and the posture information are acquired in the electric power tool; an estimation unit that estimates a content of work in which the electric power tool is used, based on the posture information, the torque information, and the time information; and an information generation unit that generates recommendation information adapted to the content of work estimated.

Optional combinations of the aforementioned constituting elements, and implementations of the present disclosure in the form of devices, systems, computer programs, recording mediums recording computer programs, etc. may also be practiced as additional modes of the present disclosure.

BRIEF DESCRIPTION OF DRAWINGS

FIG. 4 shows an example of the result of analyzing a day's work; and

DESCRIPTION OF EMBODIMENTS

Figure 1:
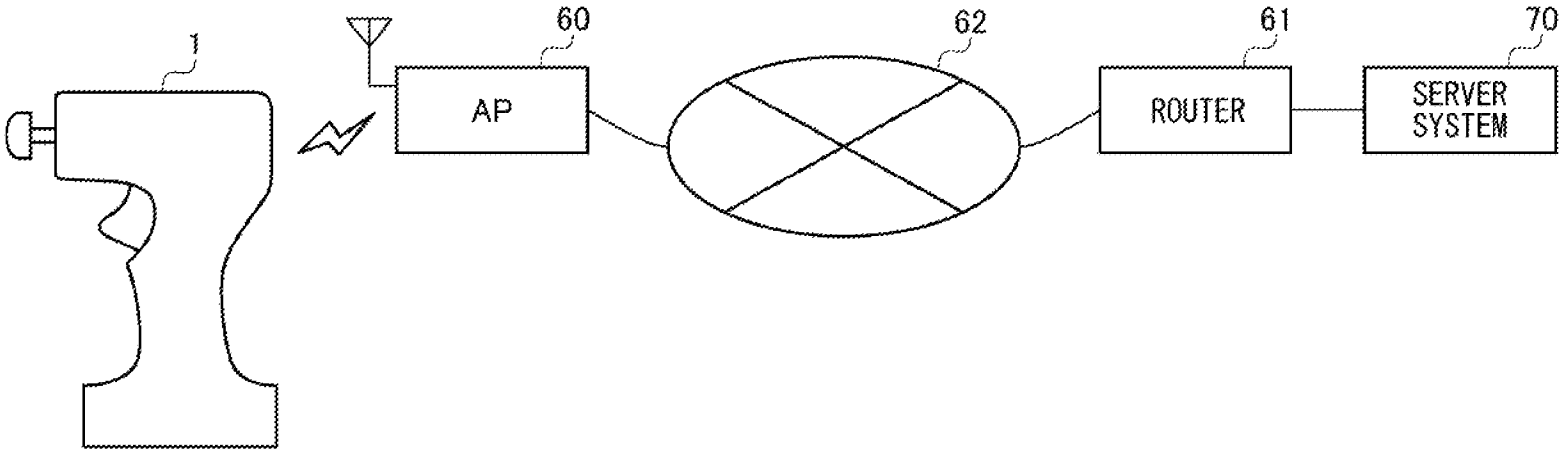
FIG. 1 shows a configuration of an electric power tool system according to an embodiment.

FIG. 1 shows a configuration of an electric power tool system 100 according to an embodiment. The electric power tool system 100 includes an electric power tool 1 and a server system 70. The server system 70 is a processing apparatus for processing various information transmitted from the electric power tool 1. An access point (hereinafter, "AP") 60 is interconnected with the electric power tool 1, which is a wireless LAN client, and is connected to an external network 62 such as the Internet. A router 61 is connected to the server system 70 by wire and is connected to the network 62. The electric power tool 1 and the server system 70 are communicably connected via the network 62.

Figure 2:
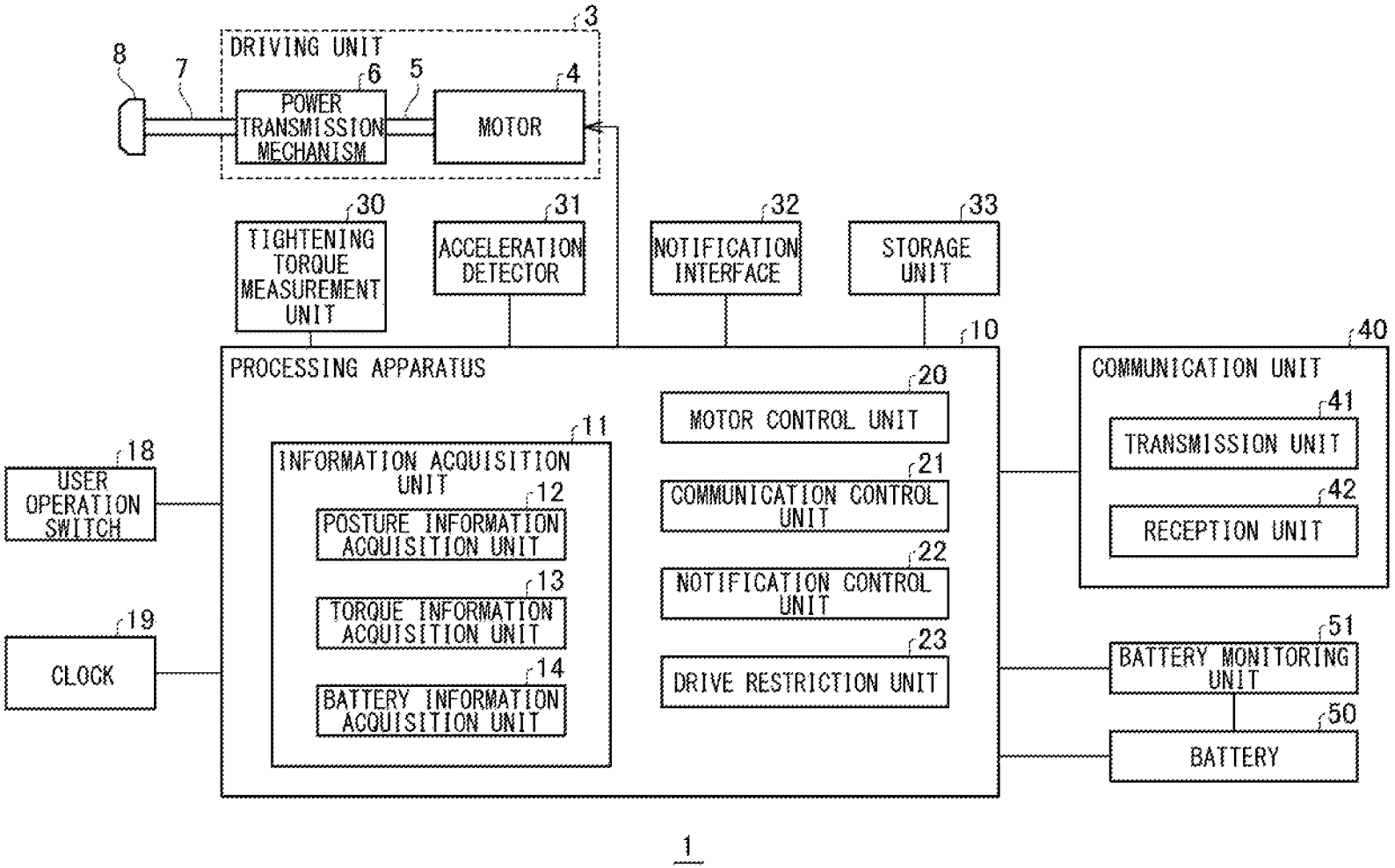
FIG. 2 shows a functional block of the electric power tool according to the embodiment.

FIG. 2 shows a functional block of the electric power tool 1 according to the embodiment. The electric power tool 1 includes a driving unit 3, a processing apparatus 10, a user operation switch 18, a clock 19, a tightening torque measurement unit 30, an acceleration detector 31, a notification interface 32, a storage unit 33, a communication unit 40, a battery 50, and a battery monitoring unit 51. The clock 19 is a real-time clock. The clock 19 generates current date and time information and supplies the information to the processing apparatus 10.

The battery 50 is a secondary battery and is housed in a battery pack separate from the main body of the tool. The battery pack is configured to be removably attached to the lower end of the main body of the tool. By mounting the battery pack on the lower end of the main body of the tool, the battery 50 supplies electric power to the constituting elements of the electric power tool 1 including a motor 4. Since battery packs of different capacities can be attached to or detached from the main body of the tool, it is preferable for a user to choose a battery pack suited to the content of his or her work.

The driving unit 3 includes the motor 4, which is driving source, and a power transmission mechanism 6 coupled to a motor shaft 5 of the motor 4, and drives an output shaft 7. A front-end tool mount 8 is coupled to the output shaft 7, and a front-end tool such as a driver that applies a tightening torque to a tightened member is adapted to be mounted on the front-end tool mount 8. The power transmission mechanism 6 transmits the rotational output of the motor 4 to the output shaft 7. The power transmission mechanism 6 may include a planetary gear deceleration mechanism in mesh with a pinion gear attached to the motor shaft 5. In the case the electric power tool 1 is an impact driver or a multi-impact driver, for example, the power transmission mechanism 6 includes an impact mechanism for applying an intermittent rotary striking force to the output shaft 7.

The tightening torque measurement unit 30 measures the tightening torque of the tightened member (screw member). The tightening torque measurement unit 30 may include a magnetostrictive torque sensor attached to the output shaft 7 and a rotation angle sensor of the output shaft 7. The torque sensor uses a coil provided in a non-rotated part to detect the variation in magnetic permeability determined by the axial distortion caused by applying a torque to the output shaft 7 and outputs a voltage signal determined by the distortion. The rotation angle sensor outputs the rotation angle of the output shaft 7. The tightening torque measurement unit 30 uses the voltage signal determined by the distortion and the rotation angle of the output shaft 7 to calculate the tightening torque of the screw member. The tightening torque measurement unit 30 outputs the measured value of the tightening torque to the processing apparatus 10 as torque information at a first sampling period. The tightening torque measurement unit 30 may measure the tightening torque only when the user operation switch 18 is manipulated by the user.

The acceleration detector 31 detects the acceleration of the electric power tool 1. The acceleration detector 31 may include a three-axis acceleration sensor and a three-axis gyro sensor. The acceleration sensor and the gyro sensor may have a capacitance-type or piezoelectric structure. The detected acceleration is used in the process of identifying the posture of the electric power tool 1 and the process of calculating the moving distance of the electric power tool 1. The acceleration detector 31 outputs the detected acceleration value to the processing apparatus 10 at a second sampling period. The acceleration detector 31 may detect the acceleration of the electric power tool 1 while the main power supply is being turned on.

The battery monitoring unit 51 monitors the status of the battery 50. The battery monitoring unit 51 includes a voltage measurement circuit for detecting the voltage value of the battery 50 for the purpose of preventing over charge or over discharge. The battery monitoring unit 51 also includes a current measurement circuit for the purpose of preventing an overcurrent. The battery monitoring unit 51 also includes a temperature measurement circuit for the purpose of detecting an abnormal temperature. The battery monitoring unit 51 outputs the measured voltage value, current value, and temperature value to the processing apparatus 10 as battery information indicating the status of the battery 50 at a third sampling period.

The communication unit 40 includes a transmission unit 41 and a reception unit 42. The communication unit 40 may be a module configured to communicate wirelessly with the AP 60 according to a communication protocol such as the IEEE802.11 protocol. The communication unit 40 may also include a wireless communication function in the fourth-generation mobile communication system. The communication unit 40 may not be a wireless communication module but a module configured to communicate with an external device by wire via, for example, a USB cable.

The notification interface 32 is an output interface for outputting information to the user. The notification interface 32 may include a speaker for audio output of information and/or a display for outputting information on a screen. The storage unit 33 is a memory and includes a read only memory (ROM) and a random access memory (RAM). The ROM stores at least identification information (tool ID) for identifying the electric power tool 1. The ROM further stores a control program used by the motor control unit 20. The RAM stores the information transmitted from the transmission unit 41 temporarily and stores the information received by the reception unit 42 temporarily.

The electric power tool or the entity that executes the method according to the disclosure is provided with a computer. By causing the computer to run a program, the function of the tool or the entity that executes the method according to the disclosure is realized. The computer is comprised of a processor that operates in accordance with the program as a main hardware feature. The disclosure is non-limiting as to the type of the processor so long as the function is realized by running the program. The processor is comprised of one or a plurality of electronic circuits including a semiconductor integrated circuit (IC) or a large-scale integration (LSI). The terms IC and LSI may change depending on the integration degree, and the processor may be comprised of a system LSI, a very large scale integration (VLSI), or an ultra large scale integration (USLI). A field programmable gate array (FPGA) programmed after the LSI is manufactured, or a reconfigurable logic device, in which the connections inside the LSI are reconfigurable or the circuitry blocks inside the LSI can be set up, can be used for the same purpose. The plurality of electronic circuits may be integrated in one chip or provided in a plurality of chips. The plurality of chips may be aggregated in one device or provided in a plurality of devices. The program is recorded in a non-transitory recording medium such as a computer-readable ROM, optical disk, and hard disk drive. The program may be stored in a recording medium in advance or supplied to a recording medium via wide area communication network including the Internet or the like.

The processing apparatus 10 is implemented by a computer carried on a control board. The processing apparatus 10 has the function for integrated control of the electric power tool 1 and performs various processes related to the electric power tool 1. The processing apparatus 10 includes an information acquisition unit 11, a motor control unit 20, a communication control unit 21, a notification control unit 22, and a drive restriction unit 23. The information acquisition unit 11 includes a posture information acquisition unit 12, a torque information acquisition unit 13, and a battery information acquisition unit 14.

The grip of the main body of the tool is provided with a user operation switch 18 that can be manipulated by the user. The user operation switch 18 may be a trigger switch that can be pulled by the user for manipulation to rotate the motor 4. The motor control unit 20 controls the rotation of the motor 4 in accordance with the on operation of the user operation switch 18 performed by the user. More specifically, the motor control unit 20 controls the current applied to the motor 4 in accordance with how much the user operation switch 18 is manipulated to adjust the the number of revolutions of the motor.

In a manufacturing line in a factory, for example, workers repeat a predetermined work and can use the electric power tool 1 of a type most suitable for the work. Meanwhile, users like interior construction workers and carpenters are required to do various works required of them by using a single electric power tool 1 in their personal possession. The user can reduce the workload or make the work efficient by using the electric power tool 1 suited to his or her work.

In the electric power tool system 100 according to the embodiment, the server system 70 has the function of collecting various information indicating the usage situation from the electric power tool 1 and estimating the content of work performed by the user. By estimating the content of work performed by the user, the server system 70 derives, as recommendation information, the type of the electric power tool 1 suited to the estimated content of work, the optimum value of the operation parameter in the electric power tool 1 being used, etc. The recommendation information is communicated to the user and is used, for example, as reference information referred to when the user purchase the electric power tool 1 in the future.

We have studied what kind of information is necessary to estimate the content of work. In order to estimate the type of the bolt actually tightened, it is necessary to derive the bolt diameter and bold length. The type of the bolt worked is relevant to the output performance of the electric power tool 1. Generally, the larger the bolt diameter and bolt length, the higher the output performance of the electric power tool 1 required. We have observed that the temporal change in the torque value measured during a work need be analyzed to derive the bolt diameter and that the time required for the bolt to be seated need be analyzed to derive the bolt length. Based on this observation, we have concluded that information related to the tightening torque value during a work is necessary in order to estimate the type of the bolt tightened.

Further, the work hours of the user serves as one criterion to estimate the level of load imposed on the user during a work. It can be said that the longer the work hours per day, the heavier the workload on the user, and the shorter the work hours, the lighter the workload on the user. Another criterion is the work posture of the user. It is observed that a work performed by orienting the electric power tool 1 downward is relatively easy, but a work performed by orienting the electric power tool 1 upward imposes a heavy load on the arm so that the fatigue builds up easily.

Further, the electric power tool 1 is often configured such that a plurality of battery packs having different capacities can be mounted. A battery pack having a large capacity makes it possible to work for a long time continuously but has a drawback in that it is heavier than a battery pack having a small capacity. For this reason, the weight of a battery pack affects the workload on the user. We have concluded that information for identifying the work hours or work posture, and, moreover, information on the usage status of the battery are necessary in order to estimate the level of load on the user.

In view of the foregoing observation, the information acquisition unit 11 according to the embodiment acquires posture information for identifying the posture of the electric power tool 1 and torque information indicating the measured value of tightening torque, in association with time information related to the time when the respective information is acquired. The information acquisition unit 11 may acquire battery information indicating the status of the battery 50, in association with time information related to the time when the battery information is acquired.

The posture information acquisition unit 12 acquires the detected acceleration value from the acceleration detector 31 as posture information for identifying the posture of the electric power tool 1. The posture information acquisition unit 12 stores the acquired posture information and the time information related to the time when the posture information is acquired in the storage unit 33, mapping the posture information to the time information.

The torque information acquisition unit 13 acquires torque information indicating the measured value of tightening torque produced by the front-end tool from the tightening torque measurement unit 30. The torque information acquisition unit 13 stores the acquired torque information and the time information related to the time when the torque information is acquired in the storage unit 33, mapping the torque information to the time information.

The battery information acquisition unit 14 acquires battery information indicating the status of the battery 50 from the battery monitoring unit 51. The battery information acquisition unit 14 stores the acquired battery information and the time information related to the time when the battery information is acquired in the storage unit 33, mapping the battery information to the time information.

The time information mapped to the respective information may be the absolute time information indicating the current time supplied from the clock 19. The mapped time information may be the relative time information indicating the time elapsed since the reference time (e.g., the date and time of manufacturing or the date and time of first use). The storage unit 33 stores the posture information, torque information, battery information, and the time information related to the time when the respective information is acquired, mapping the information to each other.

The communication control unit 21 controls the transmission operation performed by the transmission unit 41 and the reception operation performed by the reception unit 42. The communication unit 40 is connected to the server system 70 via the network 62. Of the information stored in the storage unit 33, the transmission unit 41 transmits at least the posture information, the torque information, and the time information related to the time when the respective information is acquired to the server system 70 (external apparatus). In the case the storage unit 33 stores the battery information, the transmission unit 41 may transmit the battery information and the time information indicating the time when the battery information is acquired to the server system 70.

The communication control unit 21 may read the information stored in the storage unit 33 periodically and cause the transmission unit 41 to transmit the information to the server system 70. For example, the communication control unit 21 may cause the transmission unit 41 to transmit information for a day stored in the storage unit 33, i.e. the posture information, torque information, battery information, and time information related to the time when the respective information is acquired, once a day to the server system 70. Further, every time the main power supply is turned on, the communication control unit 21 may read the information stored in the storage unit 33 when main power supply was turned on previously and cause the transmission unit 41 to transmit the read information to the server system 70.

Figure 3:
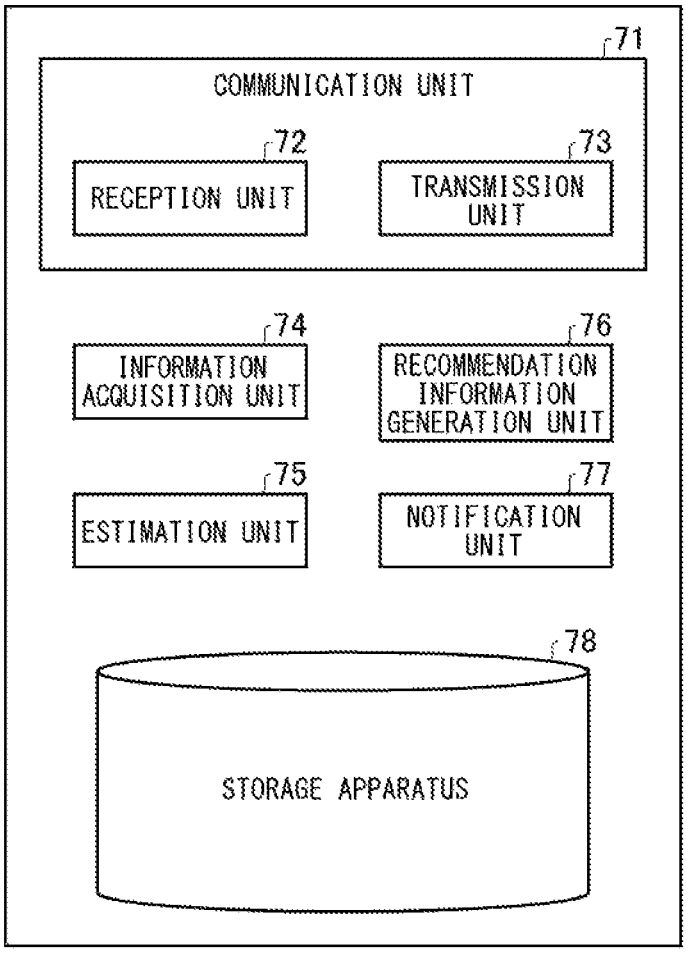
FIG. 3 shows functional blocks of the server system according to the embodiment.

FIG. 3 shows functional blocks of the server system 70 according to the embodiment. The server system 70 includes a communication unit 71, an information acquisition unit 74, an estimation unit 75, a recommendation information generation unit 76, a notification unit 77, and a storage apparatus 78. The communication unit 71 includes a reception unit 72 and a transmission unit 73.

The server system 70 may be operated and managed by, for example, an entity manufacturing the electric power tool 1. FIG. 1 shows that the server system 70 is connected only to one electric power tool 1, but the server system 70 is connected to a plurality of electric power tools 1 and receives various information acquired by the respective electric power tools 1. The transmission unit 41 in the electric power tool 1 maps various information necessary to estimate the content of work to the tool ID of the electric power tool 1 and transmits the information to the server system 70.

The reception unit 72 receives the various information transmitted from the electric power tool 1, and the storage apparatus 78 stores the received various information, mapping the information to the tool ID of the electric power tool 1. The information acquisition unit 74 reads and acquires, from the storage apparatus 78, the posture information for identifying the posture of the electric power tool 1, torque information indicating the measured value of tightening torque, and time information related to the time when the torque information and the posture information are acquired in the electric power tool 1. The following description concerns a case in which the information acquisition unit 74 acquires various information for a day in one electric power tool 1, and the estimation unit 75 estimates the content of a day's work.

The estimation unit 75 analyzes a day's work in which the electric power tool 1 is used and estimates the content of work by referring to the result of analysis, based on the posture information, torque information, and time information for a day acquired by the information acquisition unit 74. When the battery information is acquired by the information acquisition unit 74, the estimation unit 75 also uses the battery information and the associated time information to estimate the content of work in which the electric power tool 1 is used.

FIG. 4 shows an example of the result of analyzing a day's work in which each of the electric power tools A-C is used. The estimation unit 75 may analyze the various information over a plurality of days to derive a day's analysis result shown in FIG. 4.

The "work hours" field shows a day's work hours. A day's work hours may simply be a total hours for which the main power supply is turned on. Alternatively, a day's work hours may be a total hours for which the user operation switch 18 is manipulated. The hours for which the user operation switch 18 is manipulated can be derived by referring to the torque information or the posture information (acceleration information).

The "tool posture" field shows the posture of the electric power tool 1 being used in the work. The estimation unit 75 calculates the proportion of a tool posture in a day by referring to the posture information on the electric power tool 1. The proportion may be calculated by referring to the number of tightened members but may be calculated by referring to the work hours required to tighten the respective tightened members. The estimation unit 75 may calculate the work hours required to tighten the respective tightened members by using the torque information and calculate the total tightening work hours in the respective orientations to derive the proportion of a tool posture, by referring to the posture and the tightening work hours of the respective tightened members. With respect to the electric power tool A, given that the total tightening work hours of the tightened members tightened with the tool oriented downward is 3 minutes, the total tightening work hours of the tightened members tightened with the tool oriented sideways is 3 minutes, and the total tightening work hours of the tightened members tightened with the tool oriented upward is 24 minutes, oriented downward:oriented sideways:oriented upward=10%:10%:80%.

The bolt type is categorized according to the bolt diameter and bolt length. The estimation unit 75 analyzes the temporal change in the torque value measured during a work by referring to the torque information and categorizes the bolt diameter into one of small, medium, and large. The estimation unit 75 also identifies the time required for the bolt to be seated by referring to the torque information and categorizes the bolt length into one of short and long. The estimation unit 75 may determine whether the bolt length is short or long depending on whether the time required for the bolt to be seated is shorter or longer than a threshold value Tth.

The estimation unit 75 may estimate the remaining battery level by referring to the battery information for each tightening work. For example, the estimation unit 75 can estimate that the battery 50 has become deteriorated by estimating the remaining battery level for each tightening work. If there is enough remaining battery level at the end of a day's work, the estimation unit 75 may determine that the battery capacity may be smaller, though the determination depends on a day's work hours. In this way, the estimation unit 75 may analyze a day's work from the perspective of remaining battery level.

The estimation unit 75 analyzes a day's work in which the electric power tool 1 is used and estimates the content of work in which the electric power tool 1 is used by referring to the analysis result. FIG. 4 shows analysis results of three electric power tools A-C. Hereinafter, the process in the estimation unit 75 and the recommendation information generation unit 76 related to the analysis result of the electric power tool A will be described.

The estimation unit 75 estimates that the content of work in which the electric power tool A is used is characterized by the fact that the electric power tool A is often used in the upward oriented posture, bolts having a small diameter are tightened in a majority of works, and the work hours Ta are relatively short. That bolts having a small diameter are tightened in a majority of works means that high output performance is not required of the electric power tool A. That the tool is often used in the upward oriented posture means that the user's arm is likely to be heavily loaded.

The recommendation information generation unit 76 generates recommendation information adapted to the content of work estimated by the estimation unit 75. The recommendation information is provided to the user of the electric power tool 1 and may recommend an electric power tool suited to the content of work to the user. The estimation unit 75 estimates that the work hours of the electric power tool A are relatively short, high output performance is not required in a majority of works, and the tool is often used in the upward oriented posture in a work. Based on this, the recommendation information generation unit 76 may generate recommendation information recommending a type of lightweight electric power tool having only low output performance for purchase in the future. If the remaining battery level is sufficient at the end of a day's work, the recommendation information generation unit 76 may generate recommendation information to recommend a purchase of a battery pack having a small battery capacity and a light weight.

The notification unit 77 causes the transmission unit 73 to transmit the recommendation information generated by the recommendation information generation unit 76 to the electric power tool A. The notification unit 77 may cause the transmission unit 73 to transmit the recommendation information to a terminal apparatus associated with the electric power tool A (e.g., a mobile phone set of the user of the electric power tool A) instead of to the electric power tool A. In either case, the transmission unit 73 transmits the recommendation information so that the user of the electric power tool A can confirm.

The server system 70 may be comprised of one or a plurality of apparatuses. For example, the server system 70 may include a collection apparatus for collecting various information transmitted from the electric power tool 1 and an estimation apparatus for estimating the content of work of the electric power tool 1 by using the various information thus collected. In this case, the communication unit 71 and the storage apparatus 78 shown in FIG. 3 are provided as configurations on the side of the collecting apparatus, and the information acquisition unit 74, the estimation unit 75, and recommendation information generation unit 76, and the notification unit 77 are provided as configurations on the side of the estimation apparatus.

In the electric power tool 1, the reception unit 42 receives the transmitted recommendation information. The notification control unit 22 causes the notification interface 32 to communicate the recommendation information. The notification interface 32 provides an audio output of the recommendation information from the speaker or provides a screen output of the recommendation information from a display. The user can know the information recommended in relation to the electric power tool 1 being used, by referring to the content communicated from the notification interface 32 and can address the situation by exchanging the battery pack or purchase a new tool as necessary.

The notification control unit 22 may cause the notification interface 32 to communicate the recommendation information repeatedly until the user performs a confirmation operation. The confirmation operation may, for example, be an operation to press a confirmation button provided in the electric power tool 1. This causes notification control unit 22 to ensure that the recommendation information is communicated to the user. It is preferred that the drive restriction unit 23 restrict the motor 4 from being driven while the recommendation information is being communicated by the notification interface 32. In other words, the drive restriction unit 23 restricts the motor control unit 20 from driving the motor 4 while the notification interface 32 is communicating the recommendation information even if the user operation switch 18 is turned on by the user. This ensures that the electric power tool 1 is available for use after the recommendation information is communicated properly to the user.

In the example given above, the recommendation information generation unit 76 generates recommendation information including a tool type recommended for purchase. Alternatively, the recommendation information generation unit 76 may generate information indicating whether the current tool is proper. When the electric power tool A is most suitable for the content of work performed by the user, for example, the recommendation information generation unit 76 may generate information indicating that the electric power tool A used by the user is most suitable. In the case an operation parameter for controlling an operation mode can be set to the tool, the recommendation information generation unit 76 may generate the optimum operation parameter as recommendation information.

Described above is a case in which the server system 70 in the electric power tool system 100 estimates the content of work in which the electric power tool 1 is used to generate the recommendation information. A description will be given below of a case in which the electric power tool 1 estimates the content of work performed by using the electric power tool 1 on its own.

Figure 5:
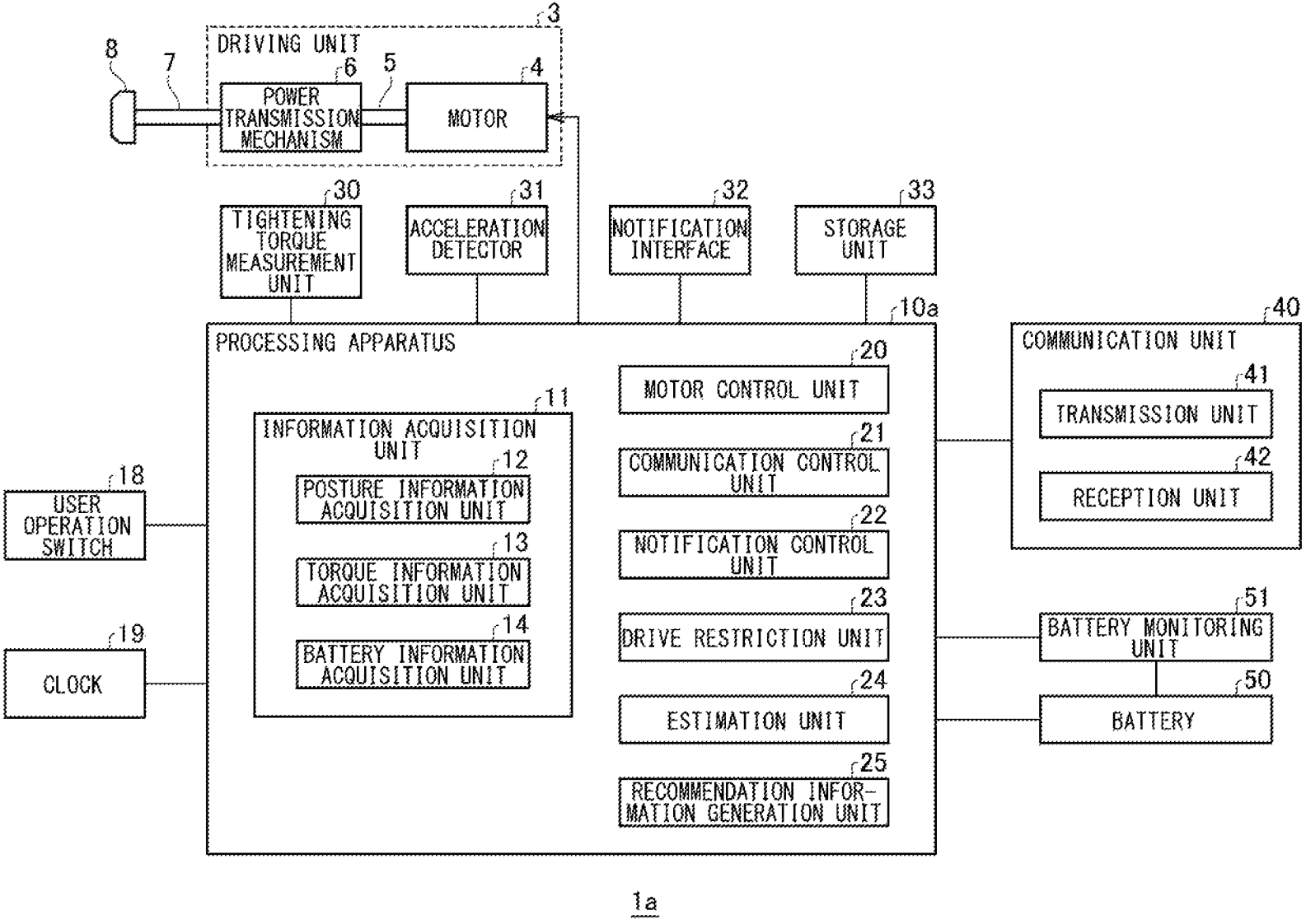
FIG. 5 shows another functional block of an electric power tool according to the embodiment.

FIG. 5 shows another functional block of an electric power tool 1*a* according to the embodiment. The electric power tool 1*a* includes the driving unit 3, a processing apparatus 10*a*, the user operation switch 18, the clock 19, the tightening torque measurement unit 30, the acceleration detector 31, the notification interface 32, the storage unit 33, the communication unit 40, the battery 50, and the battery monitoring unit 51. In the electric power tool 1 shown in FIG. 2 and the electric power tool 1*a* shown in FIG. 5, features denoted by the same symbol have the same function. Therefore, a description of those features of the electric power tool 1*a* denoted by the same symbols is omitted as appropriate. A difference from the electric power tool 1 shown in FIG. 2 is that the processing apparatus 10*a* of the electric power tool 1*a* shown in FIG. 5 includes an estimation unit 24 and a recommendation information generation unit 25 and has the function of estimating the content of work and generating recommendation information.

The information acquisition unit 11 reads and acquires, from the storage unit 33, the posture information for identifying the posture of the electric power tool 1*a*, the torque information indicating the measured value of tightening torque, and the time information related to the time when the torque information and the posture information are acquired in the electric power tool 1*a*. The information acquisition unit 11 may read and acquire the battery information and the time information related to the time when the battery information is acquired from the storage unit 33.

The estimation unit 24 analyzes a day's work in which the electric power tool 1*a* is used and estimates the content of work by referring to the result of analysis, based on the posture information, torque information, and time information for a day acquired by the information acquisition unit 11. When the battery information is acquired by the information acquisition unit 11, the estimation unit 24 may also use the battery information and the associated time information to estimate the content of work in which the electric power tool 1 is used. The recommendation information generation unit 25 generates recommendation information adapted to the content of work estimated.

The estimation process performed by the estimation unit 24 and the recommendation information generation process performed by the recommendation information generation unit 25 may be identical to the information generation process performed by the estimation unit 75 and the recommendation information generation process performed by the recommendation information generation unit 76 in the server system 70, respectively.

Described above is an explanation based on an embodiment. The embodiment is intended to be illustrative only and it will be understood by those skilled in the art that various modifications to constituting elements and processes could be developed and that such modifications are also within the scope of the present disclosure.

According to the embodiment, the electric power tool 1*a* estimates the content of work on its own so that the transmission unit 41 in the electric power tool 1*a* does not transmit the various information for estimating the content of work to the server system 70. In one variation, the transmission unit 41 in the electric power tool 1*a* may transmit the various information for estimating the content of work to the server system 70.

A summary of an embodiment of the present disclosure is given below. An electric power tool (1) according to an embodiment of the present disclosure includes: an output shaft (7) on which a front-end tool is adapted to be mounted; a power transmission mechanism (6) that transmits a rotational output of a driving source (4) to the output shaft; a posture information acquisition unit (12) that acquires posture information for identifying a posture of the electric power tool (1); a torque information acquisition unit (13) that acquires torque information indicating a measured value of tightening torque produced by the front-end tool; and a transmission unit (41) that transmits the posture information, the torque information, and time information related to a time when respective information is acquired to an external apparatus (70).

The electric power tool (1) may include: a battery (50) that supplies electric power to the driving source; and a battery information acquisition unit (14) that acquires battery information indicating a status of the battery, and the transmission unit (41) may transmit the battery information and time information related to a time when the battery information is acquired to the external apparatus (70). The electric power tool (1) may include a reception unit (42) that receives recommendation information generated based on the posture information, the torque information, and the time information; and a notification interface (32) that communicates the recommendation information received. The electric power tool (1) may include a drive restriction unit (23) that restricts the driving source from being driven while the recommendation information is being communicated by the notification interface.

A processing apparatus (10*a*, 70) according to another embodiment of the present disclosure includes: an information acquisition unit (11, 74) that acquires posture information for identifying a posture of an electric power tool, torque information indicating a measured value of tightening torque, and time information related to a time when the torque information and the posture information are acquired in the electric power tool; an estimation unit (24, 75) that estimates a content of work in which the electric power tool is used, based on the posture information, the torque information, and the time information; and an information generation unit (25, 76) that generates recommendation information adapted to the content of work estimated.

The processing apparatus (70) may further include: a transmission unit (73) that transmits the recommendation information to the electric power tool (1) or a terminal apparatus associated with the electric power tool.

The processing apparatus (10*a*) may further include: a notification interface (32) that communicates the recommendation information. The processing apparatus (10*a*) may be mounted in the electric power tool (1*a*), and the processing apparatus (10*a*) may further include a drive restriction unit (23) that restricts a driving source in the electric power tool (1*a*) from being driven while the recommendation information is being communicated by the notification interface (32).

INDUSTRIAL APPLICABILITY

The present disclosure can be used in the fields of electric power tools and processing apparatus.

REFERENCE SIGNS LIST

1, 1*a* . . . electric power tool, 10*a* . . . processing apparatus, 11 . . . information acquisition unit, 12 . . . posture information acquisition unit, 13 . . . torque information acquisition unit, 14 . . . battery information acquisition unit, 20 . . . motor control unit, 21 . . . communication control unit, 22 . . . notification control unit, 23 . . . drive restriction unit, 24 . . . estimation unit, 25 . . . recommendation information generation unit, 30 . . . tightening torque measurement unit, 31 . . . acceleration detector, 32 . . . notification interface, 33 . . . storage unit, 40 . . . communication unit, 41 . . . transmission unit, 42 . . . reception unit, 50 . . . battery, 51 . . . battery monitoring unit, 70 . . . server system, 71 . . . communication unit, 72 . . . reception unit, 73 . . . transmission unit, 74 . . . information acquisition unit, 75 . . . estimation unit, 76 . . . recommendation information generation unit, 77 . . . notification unit, 78 . . . storage apparatus, 100 . . . electric power tool system

The invention claimed is:

1. An electric power tool comprising:

a main body that includes:

an output shaft on which a front-end tool is adapted to be mounted;

a power transmission mechanism that transmits a rotational output of a driving source to the output shaft;

a posture information acquisition unit that acquires posture information for identifying a posture of the electric power tool;

a torque information acquisition unit that acquires torque information indicating a measured value of tightening torque produced by the front-end tool;

a transmission unit that transmits the posture information, the torque information, and time information related to a time when the respective information is acquired, to an external apparatus;

a reception unit that receives recommendation information generated based on the posture information, the torque information, and the time information; and a notification interface that communicates the recommendation information received, wherein the recommendation information is a type of the electric power tool suited to a content of work or an optimum value of an operation parameter in the electric power tool being used.

2. The electric power tool according to claim 1, comprising:

a battery that supplies electric power to the driving source; and a battery information acquisition unit that acquires battery information indicating a status of the battery, wherein the transmission unit transmits the battery information and time information related to a time when the battery information is acquired to the external apparatus.

3. The electric power tool according to claim 1, comprising:

a drive restriction unit that restricts the driving source from being driven while the recommendation information is being communicated by the notification interface.

4. A processing apparatus comprising:

an information acquisition unit that acquires posture information for identifying a posture of an electric power tool, torque information indicating a measured value of tightening torque, and time information related to a time when the torque information and the posture information are acquired in the electric power tool;

an estimation unit that estimates a content of work in which the electric power tool is used, based on the posture information, the torque information, and the time information; and an information generation unit that generates recommendation information adapted to the content of work estimated, wherein the recommendation information is a type of the electric power tool suited to the content of work or an optimum value of an operation parameter in the electric power tool being used.

5. The processing apparatus according to claim 4, further comprising:

a transmission unit that transmits the recommendation information to the electric power tool or a terminal apparatus associated with the electric power tool.

6. The processing apparatus according to claim 4, further comprising:

a notification interface that communicates the recommendation information.

7. The processing apparatus according to claim 6, wherein the processing apparatus is mounted in the electric power tool, and the processing apparatus further comprising a drive restriction unit that restricts a driving source in the electric power tool from being driven while the recommendation information is being communicated by the notification interface.

* * * * *